United States Patent [19]

Burton

[11] 4,301,544

[45] Nov. 24, 1981

[54] APRON ASSEMBLY

[76] Inventor: Michael J. Burton, 236 Elm St., Steele, Mo. 63877

[21] Appl. No.: 184,100

[22] Filed: Sep. 4, 1980

[51] Int. Cl.[3] ..... A41D 27/12

[52] U.S. Cl. ..... 2/49 A

[58] Field of Search ..... 2/48–52

[56] References Cited

U.S. PATENT DOCUMENTS

| | | | |
|---|---|---|---|
| 590,991 | 10/1897 | Lenhart . | |
| 2,105,029 | 1/1938 | Doty | 2/49 |
| 2,425,961 | 8/1947 | Shattuck | 2/49 |
| 2,532,932 | 12/1950 | Neiswander | 2/49 |
| 2,643,384 | 6/1953 | Thompson | 2/49 |
| 2,762,053 | 9/1956 | Lipscomb | 2/49 |

*Primary Examiner*—Doris L. Troutman

*Attorney, Agent, or Firm*—Scott R. Foster

[57] ABSTRACT

An apron assembly comprising a panel of flexible material adapted to overlie a frontal portion of a user's torso, a first connector disposed proximate a bottom edge of the panel, second and third connectors disposed along a first side edge thereof, fourth and fifth connectors disposed along a second side edge thereof, and a sixth connector adapted for attachment to an edge of a tray, the first and sixth connectors being interengageable to connect the panel to the tray and form a pocket, the second and third connectors being interengageable to close a first end of the pocket, and the fourth and fifth connectors being interengageable to close a second end of the pocket.

7 Claims, 3 Drawing Figures

6
2
8
22
24
12
20
16
10
26
28

6
2
4
14
10
26
28
1
20
12
8
22
24
1

APRON ASSEMBLY

BACKGROUND OF THE INVENTION

1. Field of the Invention

The invention relates to protective garments and is directed more particularly to an apron, or bib, type of garment for catching and retaining matter dropped by the user or falling between the user and a work tray, or food tray.

2. Description of the Prior Art

Aprons adapted to fit about the neck of an infant and attach to food trays, such as high-chair trays, are generally known in the art. For example, U.S. Pat. No. 2,105,029, issued Jan. 11, 1938 to M. M. Doty shows a bib having an upper portion which is adapted to attach to an infant's neck and a lower portion having thereon connecting means by which the lower portion of the bib is attachable to a high-chair tray. In bibs of this type, the upward turned lower portion forms a trough into which matter falls which would otherwise fall between the infant and the tray. Aprons of this type also find utility in industries in which workers assemble small and/or delicate components on work benches before them, the aprons functioning to catch and retain, for example, small electronic components which may slip from the user's grasp or fall from the work tray.

In such instances, it is helpful to have a closed-end trough to prevent matter from falling from the trough, or pocket, to the floor. U.S. Pat. No. 2,425,961, issued Aug. 19, 1947 to F. C. Shattuck, discloses a bib having a closed-end pocket in the lower portion thereof. The pocket is a permanent part of the bib.

It would be advantageous for a bib, or work apron, to have facility for attachment to a tray, and also have facility for forming a pocket therein. A further advantageous feature would be to have the pocket forming facility releasable so that the pocket may be closed and opened, as desired.

SUMMARY OF THE INVENTION

It is, therefore, an object of the present invention to provide an apron assembly having means for connecting a lower portion of the apron to a tray.

A further object of the invention is to provide such an apron having means for releasably forming therein a closed-end pocket, or trough.

A still further object of the invention is to provide such an apron as is simple and economical to manufacture and easy to operate.

With the above and other objects in view, as will hereinafter appear, a feature of the present invention is the provision of an apron assembly comprising a panel of flexible material adapted to overlie a frontal portion of a user's torso, the panel having first and second side edges interconnected by a bottom edge, the panel having a first surface bounded in part by the edges and a second surface bounded in part by the edges, first connector means disposed on the second surface proximate the bottom edge, second and third connector means disposed on the first surface proximate the first side edge and disposed further from the bottom edge than the first connector means, fourth and fifth connector means disposed on the first surface and proximate the second side edge and disposed further from the bottom edge than the first connector means, and sixth connector means adapted for attachment to an edge of a tray, the first connector means being adapted for releasable attachment to the sixth connector means to attach the panel to the tray edge and thereby form an elongated pocket in the panel, the second and third connector means being releasably interconnectable to close a first end of the pocket, and the fourth and fifth connector means being releasably interconnectable to close a second end of the pocket.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 2:
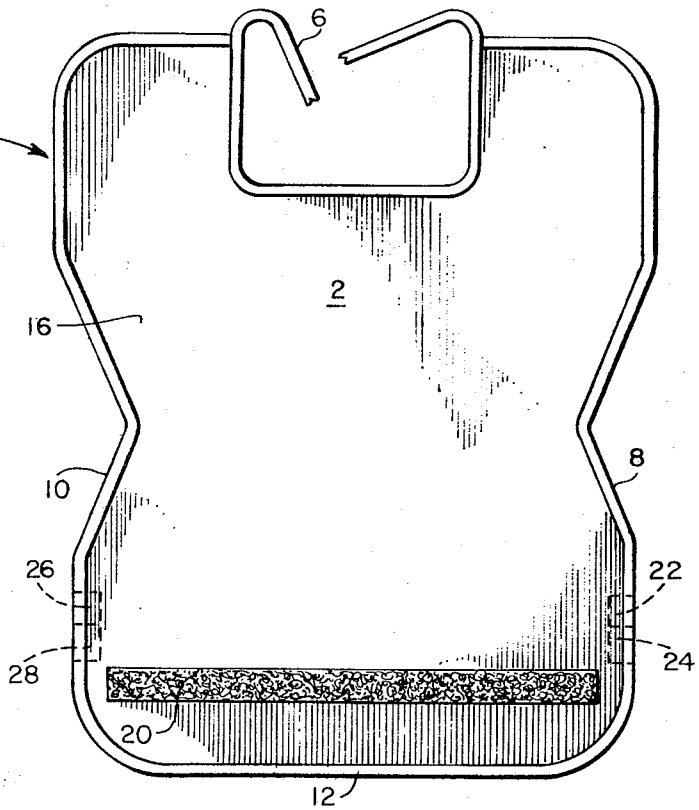
FIG. 2 is a rear elevational view thereof.
Figure 1:
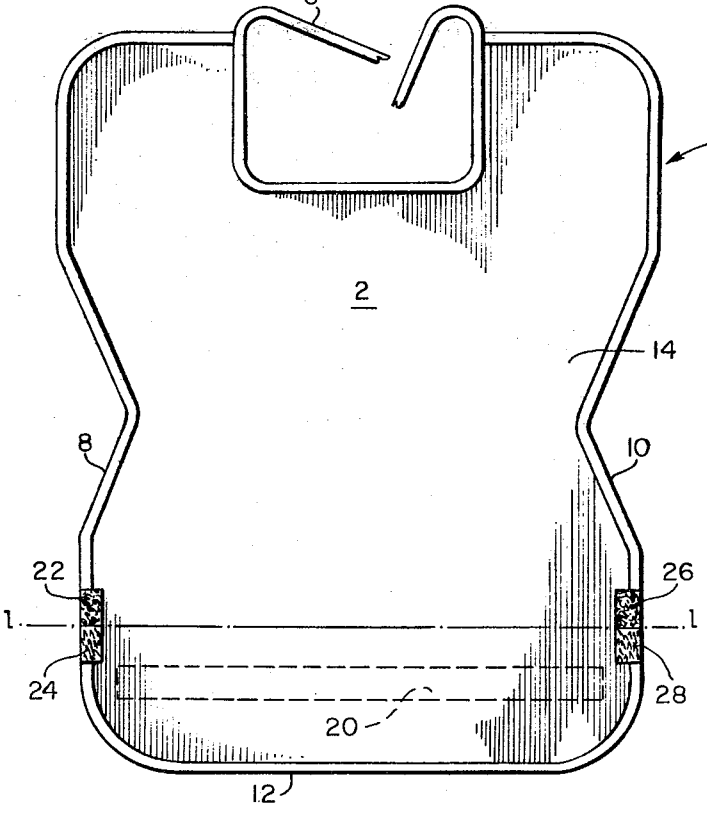
FIG. 1 is a front elevational view of an apron portion of an apron assembly.

Referring to FIGS. 1 and 2, it will be seen that the apron portion of the illustrative apron assembly includes a panel 2 of flexible material, the panel being adapted to overlie a frontal portion of a user's torso (not shown) in a known manner. The panel includes an upper portion 4 having means 6 for affixing the panel to the torso, which means may be a simple tie means, as illustrated. The panel 2 is bounded in part by a first edge 8 and a second edge 10 interconnected by a bottom edge 12. The panel includes a first, or outer, surface 14, and a second, or inner, surface 16.

A first connector means 20 is disposed substantially parallel to and proximate the bottom edge 12, the first connector being fixed to the second, or inner, surface 16. The first connector means 20 is preferably a single elongated connector, or a series of connectors, and of a hermaphroditic type, such as that known under the trademark "VELCRO". A connector of the hermaphroditic type is disclosed in U.S. Pat. No. 3,192,589 issued July 6, 1965 to Raymond C. Pearson, Second and third connector means 22, 24 are disposed on the first, or outer, surface 14 and along, or near, the first edge 8 of the panel 2. The second and third connector means 22, 24 are releasably interconnectable and are disposed further from the bottom edge than is the first connector means 20. In like manner, fourth and fifth connector means 26, 28 are disposed on the first surface 14 and along, or near, the second edge 10 of the panel 2. The fourth and fifth connector means 26, 28 are releasably interconnectable and are disposed further from the bottom edge than is the first connector means 20. An imaginary line 1—1 extending from the center of the second and third connector means 22, 24 to the center of the fourth and fifth connector means 26, 28 is disposed substantially parallel to the first connector means 20. As in the case of the first connector means 20, it is preferred that the second, third, fourth and fifth connector means 22, 24, 26 and 28, be of hermaphroditic material for ease and speed in connection and disconnection. it will be apparent that the second and third connector means 22, 24 could be a single strip of hermaphroditic material as well as two separate strips. In like manner, the fourth and fifth connector means 26, 28 could be a single strip, rather than the two separate strips shown.

Figure 3:
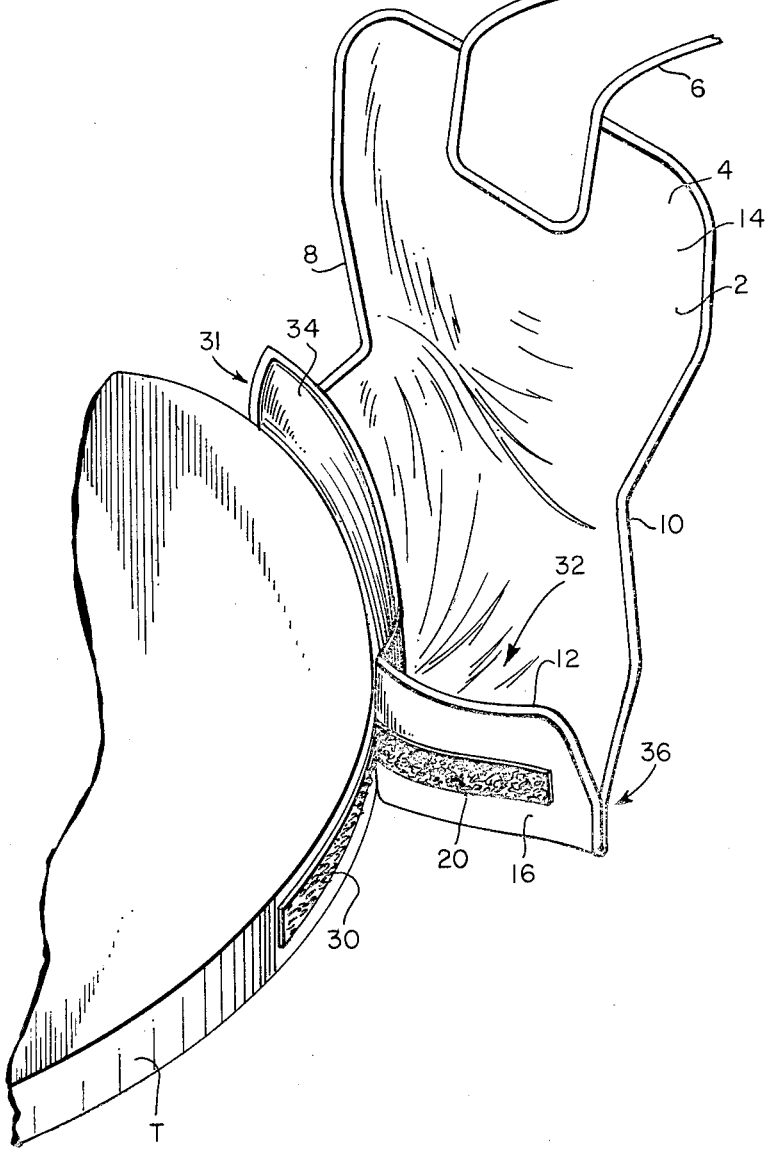
FIG. 3 is a perspective view of an apron assembly illustrative of an embodiment of the invention.

Referring to FIG. 3, it will be seen that the apron assembly includes a sixth connector means 30, which is preferably an elongated strip, or a series of strips, of hermaphroditic material of the same number, size and configuration as the first connector means 20 and having an adhesive backing for attachment of the connector means 30 to an edge of a tray T. The adhesive backing may be covered by a peel strip (not shown) to facilitate its packaging and handling prior to use. The first and sixth connector means 20, 30 are interengageable to releasably affix the panel 2 to the tray T.

In operation, the apron is attached to the neck of a user by the tie means 6. The first connector means 20 is pressed against the sixth connector means 30, which previously will have been fixed to the tray T. The second and third connector means 22, 24 are then pressed together to close a first end 31 of a trough 32 formed by the upward inclination of a lower portion 34 of the panel 2. Similarly, the fourth and fifth connector means 26, 28 are pressed together to close a second end 36 of the trough 32. Matter falling between the user and the tray is caught and retained by the trough 32, the bottom of which generally extends along the line 1—1.

The various connector means may be readily disengaged to facilitate cleaning or washing of the trough interior.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. An apron assembly comprising a panel of flexible material adapted to overlie a frontal portion of a user's torso, said panel having first and second side edges interconnected by a bottom edge, said panel having a first surface bounded in part by said edges and a second surface bounded in part by said edges, first connector means disposed on said second surface proximate said bottom edge, second and third connector means disposed on said first surface proximate said first side edge and disposed further from said bottom edge than said first connector means, fourth and fifth connector means disposed on said first surface and proximate said second side edge and disposed further from said bottom edge than said first connector means, and sixth connector means adapted for attachment to an edge of a tray, said first connector means being adapted for releasable attachment to said sixth connector means to attach said panel to said tray edge and thereby form an elongated pocket in said panel, said second and third connector means being releasably interconnectable to close a first end of said pocket, and said fourth and fifth connector means being releasably interconnectable to close a second end of said pocket.

2. The invention in accordance with claim 1 in which said panel includes an upper portion having means thereon for connection to said torso of said user.

3. The invention in accordance with claim 2 in which said first connector means comprises elongated connector means extending substantially parallel to said bottom edge.

4. The invention in accordance with claim 3 in which an imaginary line extending between the midpoint of said second and third connecting means and the midpoint of said fourth and fifth connecting means is disposed substantially parallel to said first connecting means.

5. The invention in accordance with claim 4 in which said connecting means are of hermaphroditic material.

6. The invention in accordance with claim 5 in which said sixth connector means comprises hermaphroditic material corresponding substantially in size and configuration to said first connector means.

7. The invention in accordance with claim 6 in which said sixth connector means is adhesive backed for said attachment to said tray.

* * * * *